US007264420B2

(12) United States Patent
Chang

(10) Patent No.: US 7,264,420 B2
(45) Date of Patent: Sep. 4, 2007

(54) FLOATING OVERTURN PREVENTION DEVICE

(75) Inventor: Hung-Chia Chang, Taipei (TW)

(73) Assignee: Hannspree, Inc., Taipei (TW)

( * ) Notice: Subject to any disclaimer, the term of this patent is extended or adjusted under 35 U.S.C. 154(b) by 0 days.

(21) Appl. No.: 11/283,884

(22) Filed: Nov. 22, 2005

(65) Prior Publication Data

US 2007/0059105 A1 Mar. 15, 2007

(30) Foreign Application Priority Data

Sep. 15, 2005 (TW) ..... 94215926 U

(51) Int. Cl.
*B63B 22/00* (2006.01)

(52) U.S. Cl. ..... 405/195.1; 441/21; 441/22

(58) Field of Classification Search ..... 405/195.1, 405/200; 441/21, 22
See application file for complete search history.

(56) References Cited

U.S. PATENT DOCUMENTS 2,352,862 A * 7/1944 Rabuse ..... 434/25
3,167,793 A * 2/1965 Keats ..... 441/22
3,191,202 A * 6/1965 Handler ..... 441/22
3,500,783 A * 3/1970 Johnson, Jr. et al. ..... 114/264
3,755,836 A * 9/1973 Milazzo ..... 441/22
4,962,921 A * 10/1990 Simmons ..... 472/129
6,718,130 B2 * 4/2004 Grober ..... 396/55

FOREIGN PATENT DOCUMENTS

JP 58053596 A * 3/1983
JP 11281758 A * 10/1999

* cited by examiner

*Primary Examiner*—Frederick L. Lagman
(74) *Attorney, Agent, or Firm*—Birch, Stewart, Kolasch, & Birch, LLP

(57) ABSTRACT

A floating overturn prevention device includes a flat-top base and a pillar coupled to a bottom surface of the flat-top base and extending therefrom. The flat-top base is a floating body for floating desired equipment on the water. The pillar further includes a weight member fixed on the bottom end of the pillar to maintain balance and keep the center of gravity of the floating overturn prevention device under the water. The floating overturn prevention device filter includes a balancing member coupled to the bottom end of the pillar. The balancing member includes a plurality of balancing plates vertical to the water level when the floating overturn prevention device balances on the water level. Therefore, the balancing plates can generate a reaction force to keep the floating overturn prevention device stable.

10 Claims, 6 Drawing Sheets

FLOATING OVERTURN PREVENTION DEVICE

RELATED APPLICATION

The present application is based on, and claims priority from, Taiwan Patent Application Number 94215926, filed Sep. 15, 2005, the disclosure of which is hereby incorporated by reference herein in its entirety.

BACKGROUND OF THE INVENTION

1. Field of Invention

The invention relates to a floating overturn prevention device and, in particular, to a floating overturn prevention device that can freely move and stably float on the water level for supporting a flat panel display.

2. Related Art

To float a dense object or an object that is not waterproof, a floating body is often used to support such an object.

If one wants to watch programs played by a flat panel display, such as a liquid crystal display (LCD) in a swimming pool, the LCD has to be placed on the ground or on a platform by the pool. In this case, the distance and angle for the user to watch the LCD are restricted.

Using a floating body with a flat-top base to support the LCD on water is likely to be unstable. Waves may topple the floating body, and thus the LCD, into the water.

To make the floating body stable on the water, a conventional solution is to attach an anchor with a chain to the bottom of the flat-top base, and fix the anchor at the bottom of the water. Thus, the floating body is kept at a fixed distance from the bottom of the water, thereby making the floating body stable. However, it is very inconvenient to fix the anchor at the bottom of the water each time the floating body is installed or uninstalled. Besides, even though the floating body is stabilized because of the fixed distance to the bottom of water, the floating body can hardly move around. The viewing distance and angle are still restricted for a user who wants to swim around in the pool.

SUMMARY OF THE INVENTION

An objective of the invention is to provide a floating overturn prevention device to stably support and float an object on water.

Another objective of the invention is to provide a floating overturn prevention device that can float to any desired position on water.

To achieve the above-mentioned objectives, the disclosed floating overturn prevention device includes a flat-top base and a pillar. The flat-top base is a floating body for supporting the desired equipment on the water. The pillar is coupled to a bottom surface of the flat-top base and extends therefrom. The pillar keeps the center of gravity and balance of the floating overturn prevention device under the water.

The floating overturn prevention device further includes a balancing member coupled to the bottom end of the pillar. The balancing member includes a plurality of balancing plates vertical to the water level when the floating overturn prevention device balances on the water level. Therefore, the balancing plates can generate a reaction force to keep the floating overturn prevention device stable. The balancing plates are coupled to the pillar with a plurality of brackets. The balancing plates can also be coupled to the pillar in a radiating way.

The water level lines of adjacent balancing plates are on different planes. The water level lines of opposite balancing plates are on the same plane. Besides, the pillar includes a weight member fixed on the bottom end of the pillar, which enhances the stability of the flat-top base because it further lowers the center of gravity of the floating overturn prevention device in the water.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
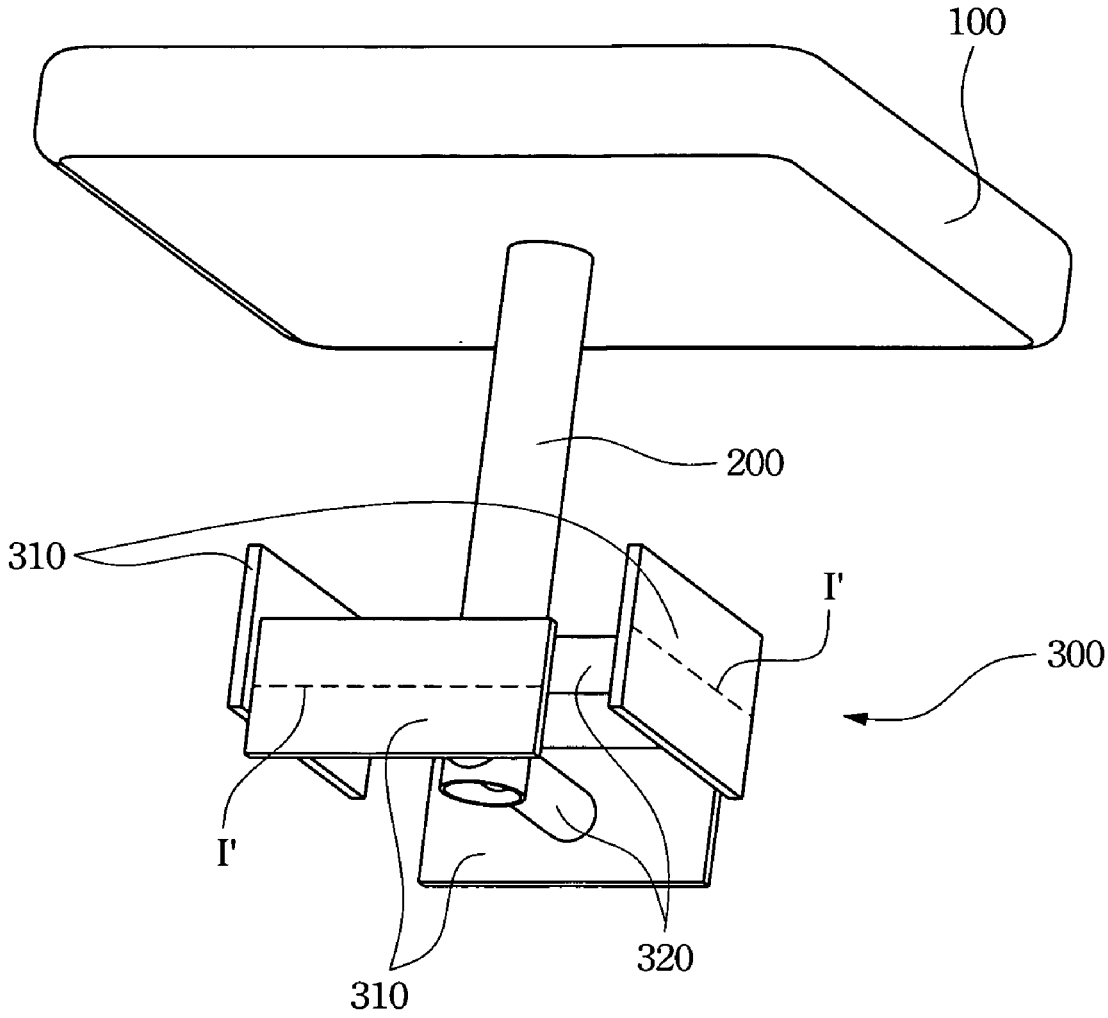
FIG. 1 is a three-dimensional bottom view of the disclosed floating overturn prevention device.

As shown in FIG. 1, the disclosed floating overturn prevention device includes a flat-top base 100 and a pillar 200. The flat-top base 100 is a floating body for supporting desired equipment, such as a liquid crystal display (LCD).

Preferably, the pillar 200 is vertically coupled to the bottom of the flat-top base 100 and extends therefrom.

Figure 2:
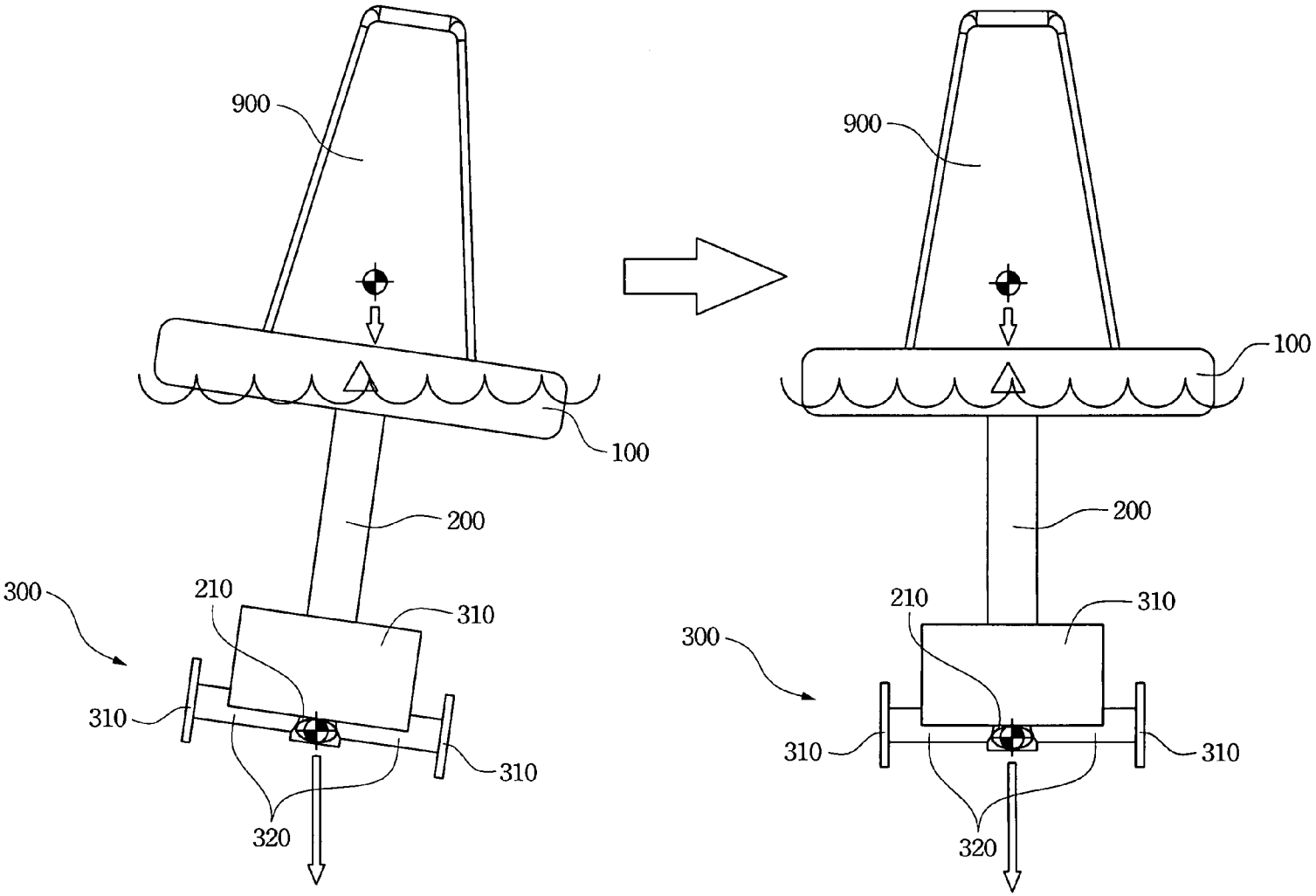
FIG. 2 is a side view of the disclosed floating overturn prevention device.

As shown in FIG. 2, when the floating overturn prevention device floats on the water, the intersection point of the water level of the flat-top base 100 and the vertical line of the pillar 200 forms the pivotal point. The pillar 200 underneath the water surface and the supported object 900 above the water surface forms a balancing arm. The length and weight of the pillar 200 are adjusted according to the weight of the supported object 900 on the flat-top base 100 and the floating force provided with the flat-top base 100. Alternatively, the bottom of the pillar 200 can be attached with a weight member 210. The length of the pillar 200 arm underneath the water surface is greater than the height of the supported object 900 above the water surface. Therefore, the center of gravity of the whole system is below the water level, making the floating overturn prevention device stable.

The disclosed floating overturn prevention device further includes a balancing member 300 disposed at the bottom of the pillar 200. The balancing member 300 is comprised of several symmetrically disposed balancing plates 310. There are preferably to be four balancing plates 310 with equal shape and size.

Figure 3:
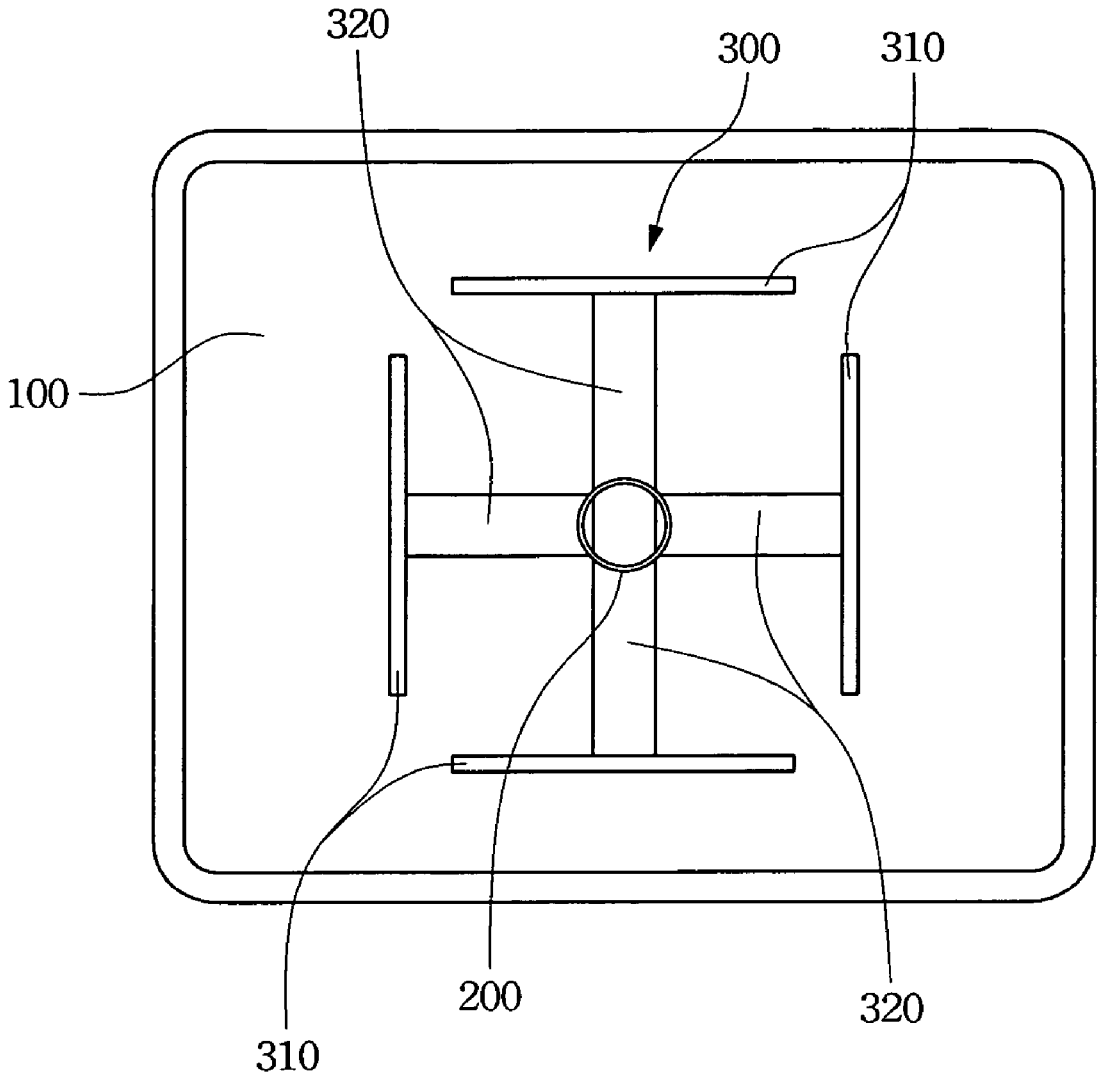
FIG. 3 is a bottom view of the disclosed floating overturn prevention device.

The balancing plates 310 are roughly vertical to the water level when the floating overturn prevention device is balanced, and are coupled to the pillar 200 with several brackets 320. As shown in FIG. 3, as viewed from the bottom of the floating overturn prevention device, the center of each balancing plate 310 is vertically coupled to one end of each bracket 320. The other end of each bracket 320 is coupled to the pillar 200, forming a cross. The extension lines of the balancing plates 310 preferably form a rectangle or even a square. The water level lines 1 of adjacent balancing plates 310 are on different planes, whereas those of opposite balancing plates 310 are on the same plane (see FIG. 1).

Figure 4:
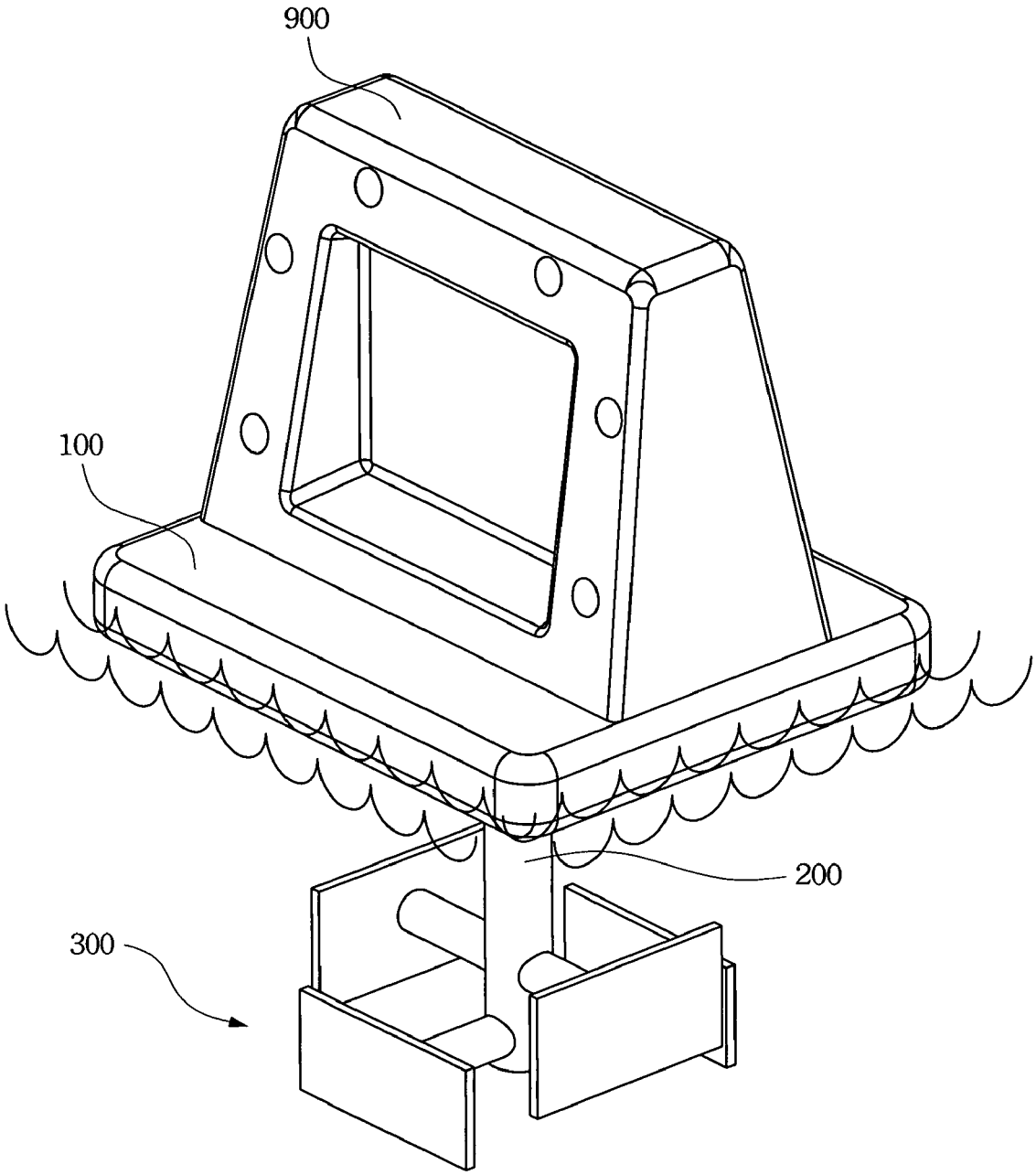
FIG. 4 shows the disclosed floating overturn prevention device in use.

In addition to the overturn prevention effect, due to the pillar 200 lowering the center of gravity of the floating overturn prevention device, one may further use the balancing member 300 to enhance the effect. If the supported object 900 is moved by an external force, the balancing plates 310 below the water surface generate a reaction force due to the resistance of water, thereby canceling the external force imposed on the supported object 900. The state of the floating overturn prevention device in use is shown in FIG. 4.

Various modifications can be made within the scope of the invention. For example, the flat-top base 100 in the drawing is rectangular. In practice, it can be any shape. The pillar 200 is not limited to the cylinder being perpendicular to the flat-top base 100, as long as the length of pillar 200 arm below the water surface is longer than the height of the supported object above the water surface. The pillar 200 may have an arbitrary shape.

Figure 5:
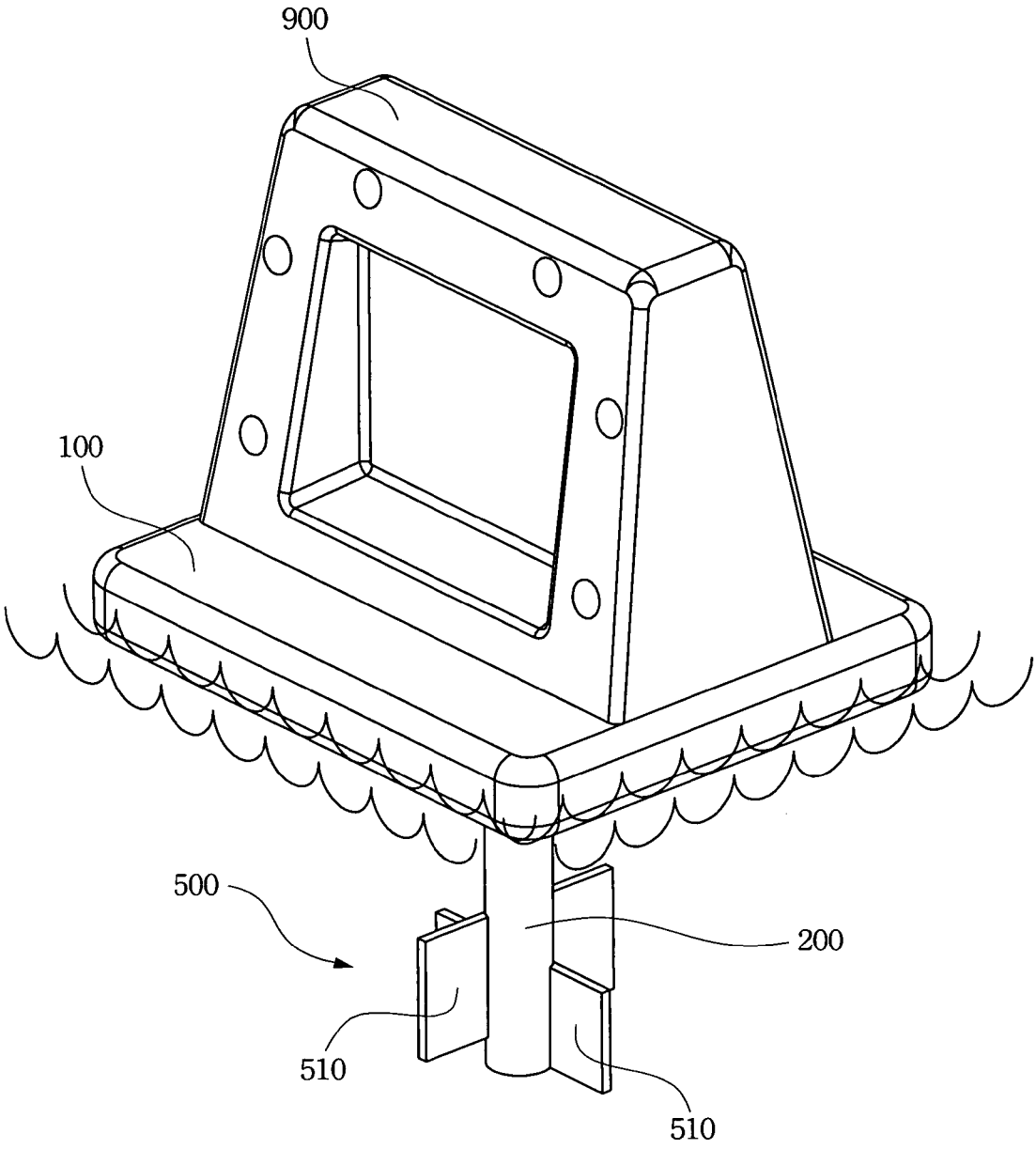
FIG. 5 is a three-dimensional view of first embodiment of the invention.

As shown in FIG. 5, the floating overturn prevention device further includes a balancing member 500 disposed at the bottom of the pillar 200. The balancing member 500 preferably has two balancing plates 510 of the same shape and size. The plane of the balancing plate 510 is roughly vertical to the water level when the floating overturn prevention device is stable. When viewed from the bottom of the floating overturn prevention device, the balancing plates 510 are disposed in a radiating way from the pillar 200, forming a cross. As in the case of the above-mentioned balancing member 300, the reaction force produced by the balancing plates 510 maintain the stability of the system. The water level lines of adjacent balancing plates 510 are on different planes, whereas the water level lines of opposite balancing plates 510 are on the same plane.

Figure 6:
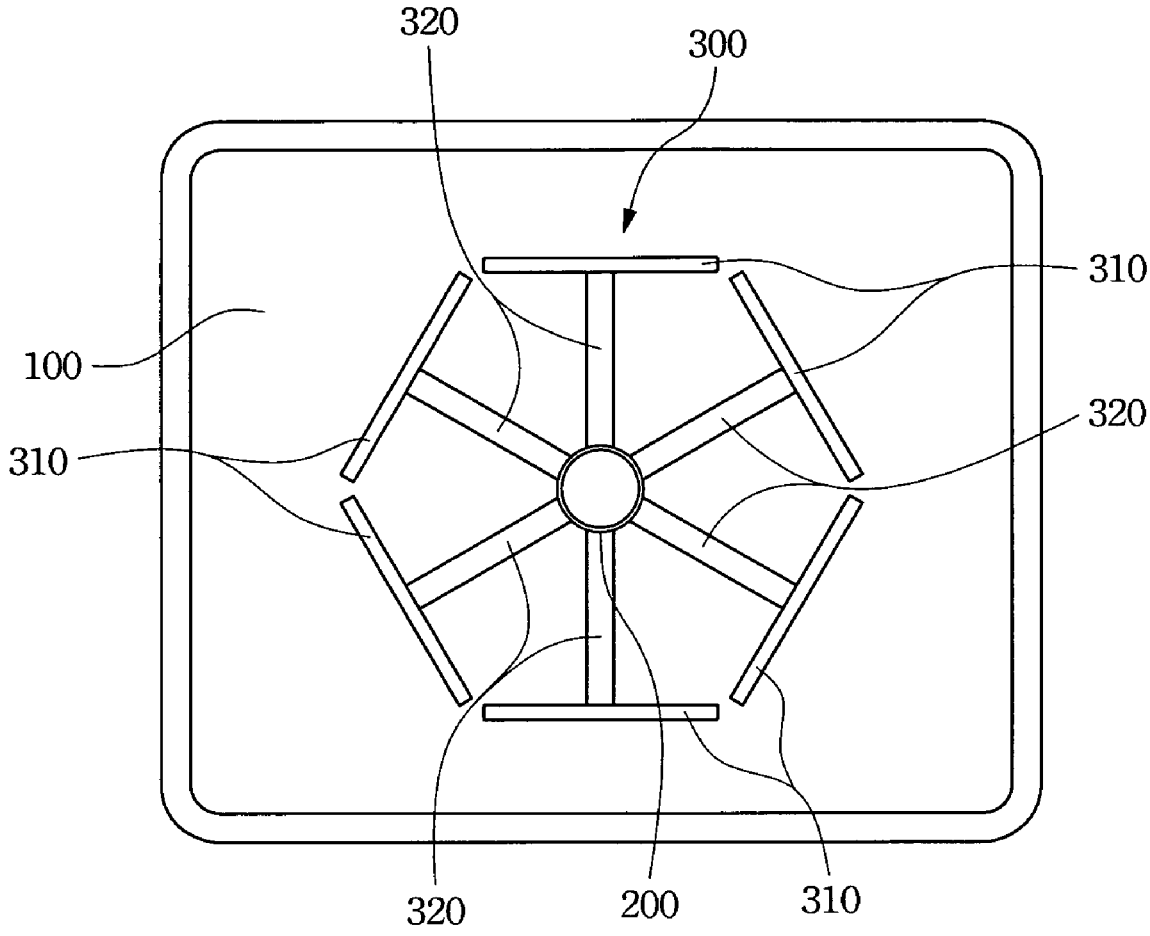
FIG. 6 is a three-dimensional view of second embodiment of the invention.

As shown in FIG. 6, the water current underneath the water surface is not limited to only two directions. Therefore, the balancing member 300 can include several balancing plates 310, the planes of which are roughly perpendicular to the water level when the floating and preventing overturn device is stable. The balancing plates 310 are coupled to the pillar 200 via several brackets 320. The reaction force generated by the balancing plates 310 maintains the stability of the system. The water level lines of adjacent balancing plates 310 are on different planes, whereas the water level lines of opposite balancing plates 310 are on the same plane (not shown). Likewise, the balancing member can include several balancing plates 510. The planes of the balancing plates 510 are roughly perpendicular to the water level when the floating and preventing overturn device is stable. When viewed from the bottom of the floating overturn prevention device, the balancing plates 510 are disposed in a radiating way from the pillar 200. The reaction force produced by the balancing plates 510 maintains lie stability of the system. All such variations should be included in the scope of the invention.

According to the above-mentioned embodiments, the disclosed floating and preventing overturn device can support objects without toppling. Moreover, it can float the supported object to arbitrary positions on the water surface.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A floating overturn prevention device, comprising:

a flat-top base, which is a floating body for floating desired equipment on water;

a pillar, which is coupled to the bottom of the flat-top base and extends therefrom, and which keeps the center of gravity of the floating overturn prevention device below the water surface; and a balancing member disposed at the bottom of the pillar, the balancing member including a plurality of balancing plates vertical to the water level when the floating overturn prevention device balances on the water level, so that the reaction force generated by the plurality of balancing plates in the water maintains the stability of the flat-top base, wherein the water level lines of the adjacent balancing plates are on different planes and the water level lines of the opposite balancing plates are on the same plane.

2. The floating overturn prevention device of claim 1, wherein the pillar further includes a weight member disposed at the bottom of the pillar to keep the center of gravity of the floating overturn prevention device below the water surface, enhancing the stability of the flat-top base.

3. A floating overturn prevention device, comprising:

a flat-top base, which is a floating body for floating desired equipment on water;

a pillar, which is coupled to the bottom of the flat-top base and extends therefrom, and which keeps the center of gravity of the floating overturn prevention device below the water surface; and a balancing member, which is disposed at the bottom of the pillar and includes a plurality of balancing plates, the plurality of balancing plates being vertical to the water level when the floating overturn prevention device balances on the water level and radiating from the pillar when viewed from the bottom of the floating overturn prevention device, so that the reaction force generated by the plurality of balancing plates in the water maintains the stability of the flat-top base, wherein the water level lines of the adjacent balancing plates are on different planes and the water level lines of the opposite balancing plates are on the same plane.

4. The floating overturn prevention device of claim 3, wherein the pillar further includes a weight member disposed at the bottom of the pillar to keep the center of gravity of the floating overturn prevention device below the water surface, enhancing the stability of the flat-top base.

5. A floating overturn prevention device, comprising:

a flat-top base, being a floating body for floating a desired equipment on water;

a pillar, which is coupled to the bottom of the flat-top base and extends therefrom, and which keeps the center of gravity of the floating overturn prevention device below the water surface; and a balancing member disposed at the bottom of the pillar, the balancing member including a plurality of balancing plates vertical to the water level when the floating overturn prevention device balances on the water level, so that the reaction force generated by the plurality of balancing plates in the water maintains the stability of the flat-top base, wherein the plurality of balancing plates are symmetrically disposed around the pillar, and wherein the water level lines of the adjacent balancing plates are on different planes and the water level lines of the opposite balancing plates are on the same plane.

6. The floating overturn prevention device of claim 5, wherein a length of the pillar is greater than a height of the desired equipment.

7. The floating overturn prevention device of claim 5, wherein the balancing member comprises two pairs of parallel balancing plates.

8. The floating overturn prevention device of claim 7, further comprising two brackets, each of which respectively interconnects each pair of parallel balancing plates, wherein the two brackets form a cross when viewed from the bottom of the floating overturn prevention device.

9. The floating overturn prevention device of claim 5, wherein the balancing member comprises three pairs of parallel balancing plates.

10. The floating overturn prevention device of claim 9, further comprising three brackets, each of which respectively interconnects each pair of parallel balancing plates.

* * * * *